US007902998B2

(12) United States Patent
Wheaton

(10) Patent No.: US 7,902,998 B2
(45) Date of Patent: Mar. 8, 2011

(54) REMOTELY-CONTROLLED TRAFFIC CONTROL SYSTEM

(75) Inventor: Brian Wheaton, Elmsdale (CA)

(73) Assignee: Allcrete Restoration Limited, Nova Scotia (CA)

( * ) Notice: Subject to any disclaimer, the term of this patent is extended or adjusted under 35 U.S.C. 154(b) by 349 days.

(21) Appl. No.: 12/039,338

(22) Filed: Feb. 28, 2008

(65) Prior Publication Data

US 2008/0204276 A1 Aug. 28, 2008

(30) Foreign Application Priority Data

Feb. 28, 2007 (CA) ..... 2579973

(51) Int. Cl.
*G08G 1/095* (2006.01)

(52) U.S. Cl. ..... 340/908; 340/908.1; 901/15

(58) Field of Classification Search ..... 340/907, 340/908.1, 908, 925; 116/63 P, 63 R; 901/15
See application file for complete search history.

(56) References Cited

U.S. PATENT DOCUMENTS

| | | | | |
|---|---|---|---|---|
| 2,199,756 | A * | 5/1940 | Ricard | 340/481 |
| 5,001,475 | A * | 3/1991 | Scovin | 340/908 |
| 5,422,638 | A * | 6/1995 | Singer et al. | 340/908.1 |
| 6,052,067 | A * | 4/2000 | Nuxoll | 340/908 |
| 6,104,313 | A | 8/2000 | Boyd, II | |
| 6,150,957 | A * | 11/2000 | Henz et al. | 340/908 |
| 6,204,777 | B1 * | 3/2001 | Lyons | 340/908 |
| 6,448,905 | B1 * | 9/2002 | Jones | 340/907 |
| 2006/0232441 | A1 * | 10/2006 | Hill | 340/907 |

* cited by examiner

*Primary Examiner* — Brent Swarthout
(74) *Attorney, Agent, or Firm* — McDermott Will & Emery LLP

(57) ABSTRACT

A system and apparatus controls the movement of vehicles such as highway traffic. The system includes a plurality of inorganic entities which simulate mammalian figures and control apparatus which is operatively associated with the mammalian figures such as to control their respective movement upon activation by an activation assembly. A system actuating means is provided whereby upon selected system actuation the mammalian figures are caused to issue signals to effectively control the movement or arrest of traffic within the effective area of operation of the system.

18 Claims, 5 Drawing Sheets

REMOTELY-CONTROLLED TRAFFIC CONTROL SYSTEM

RELATED APPLICATION

This application claims the benefit of Canadian Provisional Patent Application No. 2,579,973 filed 28 Feb. 2007, the entire contents of which are incorporated herein by reference.

FIELD OF THE INVENTION

The present invention relates to an adjustable traffic control system. In particular, the present invention relates to a traffic control system with a remotely-controlled portable, automated traffic control system having a STOP/SLOW sign and movable arm for use at a construction site.

BACKGROUND OF THE INVENTION

During construction projects on any road or highway, there is a need and/or, in some jurisdictions, a legal requirement for traffic to be controlled and directed by the contractor or the owner. This traffic control may consist of an assortment of items (Traffic Control Persons, arrow boards, Jersey Barriers, pylons, barrels, temporary portable traffic lights, signage etc.). In the case of a human TCP, they are generally placed at the start of the construction zone and stand on the edge of the road holding a pole with Stop and Slow signs attached back-to-back. In conjunction with an additional TCP at the other end of the construction zone, they will allow one direction of traffic to proceed at a time. These TCPs must be in line of sight to signal each other visually or be equipped with two-way radios so as to be in contact at all times. For the system to work properly, both TCPs must maintain a very high degree of alertness at all times and a third TCP must be available to relieve the other TCPs for meals and bathroom breaks.

Human TCP's or "flag men" have been used for many years. However, there are inherent risks to the TCP's themselves. In particular, the TCP may be placed on the highway in a dangerous location where they may easily be struck by oncoming traffic resulting in possibly serious injury or death. Human TCPs also are susceptible to many other factors which may decrease their alertness level such as boredom, tiredness, ambient temperatures/weather, distractions, sickness. The use of a human TCP is, thus, a labour intensive undertaking with the worker requiring certified training. There is also a lack of persons willing to work in the trade due to the potential danger, relatively low pay, required training and the long hours. As a result, worker-turnover is constantly at a high level and, at times, construction projects have had to be delayed or stopped temporarily due to a shortage of TCPs. It would be beneficial to all concerned to be able to replace the workers in the most dangerous locations with automated units that are remotely controlled by a certified-TCP who can position themselves inside the construction safety zone.

Several prior art devices have been developed in order to address the safety issues related with workers posted as human TCPs or flagmen at construction sites.

U.S. Pat. No. 6,448,905 to Jones discloses a robotic traffic signaling device for reducing the need for deploying workers at various construction sites. The device comprises a weighted base member for resting the device on a ground surface and a statute-like member shaped like a human being mounted on the base. A two-sided traffic sign member is rotatably attached to a hand-like member of the statute and an assembly for rotating the sign is disposed in the body of the statute. Light-emitting members are generally disposed on the sign and the statute for attracting attention thereto. A power source, a radio receiver, and an antenna are also provided on the statute for powering the rotation assembly and the light-emitting members and for communicating with a remote radio transmitter. The robotic traffic signaling device can be positioned along a road and may be controlled by a user for displaying an appropriate traffic signal via a radio transmitter.

U.S. Pat. No. 6,052,067 to Nuxoll teaches an automated traffic control device that can replace a flagman in controlling traffic. The device comprises a simulated flagman mounted on folding legs. The legs form a sawhorse type base when extended and are adapted for easy storage when folded. A two-sided traffic control sign is supported on an arm of the simulated flag-man and a motor disposed thereon turns the sign 180 degrees in either direction to expose one side or the other of the traffic control sign. The motor is controlled by a wireless remote transmitter and receiver by a flag man who can be located in a position of safety from the traffic. Nuxoll also discloses a video camera that can be disposed on the simulated flag man to monitoring the traffic.

U.S. Pat. No. 6,104,313 to Boyd II describes a remotely controlled, portable, automated flagman which takes the place of a human flagman with a handheld sign in zones where temporary traffic control is needed. The automated flagman comprises a shaft rotatably supported by a housing containing a drive mechanism and control electronics to selectively turn the shaft such that a suitable sign is displayed. A tripod or other type of support structure is attached to the housing so as to support the traffic control sign at a proper height above the ground.

The invention was made in recognition of the need to provide a remotely controlled traffic control person (TCP) which is easily transportable, designed for a quick seteo and impervious to weather conditions.

SUMMARY OF THE INVENTION

According to the present invention there is provided system and apparatus for controlling the movement of vehicles such as highway traffic, the system including the provision of a plurality of inorganic entities simulating mammalian figures control apparatus operatively associated with the mammalian figures such as to control the movement thereof upon actuation means of the system including a driving assembly structured to drive the system in operation and system actuating means operatively associated therewith whereby upon selected system actuation the mammalian figures are caused to issue signals purposed to effectively govern and control the movement or arrest of traffic in the proximate area of effective operation of the system.

According to a further aspect of the invention there is provided a robotic traffic signalling system comprising an object simulating a mammalian figure structured and dimensioned for stable positioning on a highway or the like a signalling support member mounted for operation immediately adjacent the mammalian figure the signalling support member being adapted for detachable connection to the figure and being movable from one position to another the movements of the member being such as to facilitate the control of traffic by selective signalling.

A preferred embodiment of the present invention provides a method whereby said synchronized animated movement of said body is indicative of a human traffic control operative, said body covered in distinct operative clothing. The synchronized movement of said arm and control signal is engaged when an operator remotely determines to instigate a communication signal to change said traffic control signal to direct traffic in a pre-determined way. Accordingly, direction of traffic is indicated by the animated movement of the body having a synchronized raising of the arm and turning of the control signal directing traffic to go slowly, said arm is raised by mechanical constructs hinged about a counter weight and an air ram, said arm pivotally hinged and operable actuated by said base to effect the animated feature of the control operative. The method incorporates a lowering of said arm in synchronized movements with a rotation of said control signal operably indicates to traffic to stop, release of compressed air from said base releases said control signal and said arm, a spring return attached to said base and control signal is used for turning back said control signal to signal traffic to stop, said counter weight in said arm is used for lowering said arm.

In a further preferred embodiment of the present invention adjustable securement devices are used for adjustment and securement of said base on uneven ground. Accordingly, the present invention provides a kit for controlling traffic remotely comprising: a hollow body, an adjustable base releasably attached to said body, a traffic control fixture releasably attached to the body and the base, a receiver attached to the base, body or both therein, said kit further including mechanical, electrical or both devices therein for effecting at least one operable animated feature indicative of a human traffic control operative, said base operably controlling said feature, said system having a communication link for remote operation thereof and a power source attached to the base, body or both.

An embodiment of the present invention provides an air ram drive case for operably synchronizing movement of both said fixture and said feature at the same time, a weighted power pack, a gear box for use with the air ram and staff, a remote control receiver, manual override switches, receiving apertures for releasably retaining said feature and adjustable pins for evenly securing said base to uneven ground.

In accordance with still another preferred embodiment of the present invention, there is provided an automated remotely controlled human figurine mounted on an adjustable base. The intent is to replace a human TCP with the automated unit thereby increasing worker safety and reducing construction costs. The human figurine may be holding a Stop/Slow sign in his right hand. The figurine may be dressed in bright coveralls and additional Personal Protective Equipment as may be required by local laws and regulations (i.e. hard hat, reflective traffic vests, reflective arm bands, and work boots) to increase the recognisability of the unit as a TCP and to attract the attention of approaching motorists. The unit is preferably be positioned in the same location on the construction site as required for a human TCP and the base will be adjustable to keep the unit level.

On highways, any sign may be very susceptible to high winds and must be able to resist being blown over. In addition to the heavy base, the control module and the battery storage compartment work as extra weights to create a stable base. If extremely high wind conditions exist, extra weights such as sand bags or blocks of metal may be placed on top of the battery compartment to increase stability even further.

These units will have the ability, due to dimensions and weight, to allow their setup (including loading and unloading from a pickup truck) and control by at least and, preferably, one man. Multiple units can be transported in one truck. The units may be powered, for example, by a 12-volt battery, which will allow for them to be powered by a 12-volt automotive charging system and jumper cables in an emergency. An optional part of the system would be the ability to connect a small solar panel to the battery to maintain the unit's battery in top condition. The units are, preferably, weatherproof to protect the operating parts.

The sign and arm are, in a preferred embodiment, actuated by means of a remotely activated servo which will extend spring-loaded air cylinders to cause the corresponding parts to move as desired to preset limits. Activation of the switch allows air pressure to enter the air cylinder and moves the sign to 'Slow'. When the switch is shifted in the opposite direction, the sign moves to the 'Stop' position by the release of air pressure and the recoiling of the tensioned spring.

The units, preferably, but not limited to, comprise a base with adjustable legs, a control module, a battery storage box, a solar panel, a remote control unit that will operate an air valve to rotate the sign as directed, and a human figurine holding a Stop/Slow sign. Included will be a radio transmitter module with multiple channels to control two or more automated TCPs.

The basic unit consists, preferably, of two automated units with a corresponding transmitter. A more advanced transmitter may be provided to control multiple units, as the site conditions mandate.

The unit may further comprise a remote video camera attached to each ATCP which will send live video to the human TCP; a means for transmitting the video feeds to a remote office or internet location; a means for recording the video feeds for use in establishing facts following and accident; a digital message board located, preferably at feet of the unit; and a Programmable Logic Controller (PLC).

BRIEF DESCRIPTION OF THE DRAWINGS

The preferred embodiments of the present invention will now be described, by way of example, with reference to the accompanying drawings, in which.

DETAILED DESCRIPTION OF THE INVENTION

Although other applications may be envisioned for the traffic control system of the present invention, such as a system to control traffic that requires adaptation to various environments, the use of the system of the present invention is particularly advantageous in terrains requiring mobility of the system and adaptation thereof. Accordingly, without intending to limit the present invention to the embodiments described herein, the invention will be described below in further detail having regard to the adjustable traffic control system and devices thereof shown in FIGS. 1 to 5.

Figure 1B:
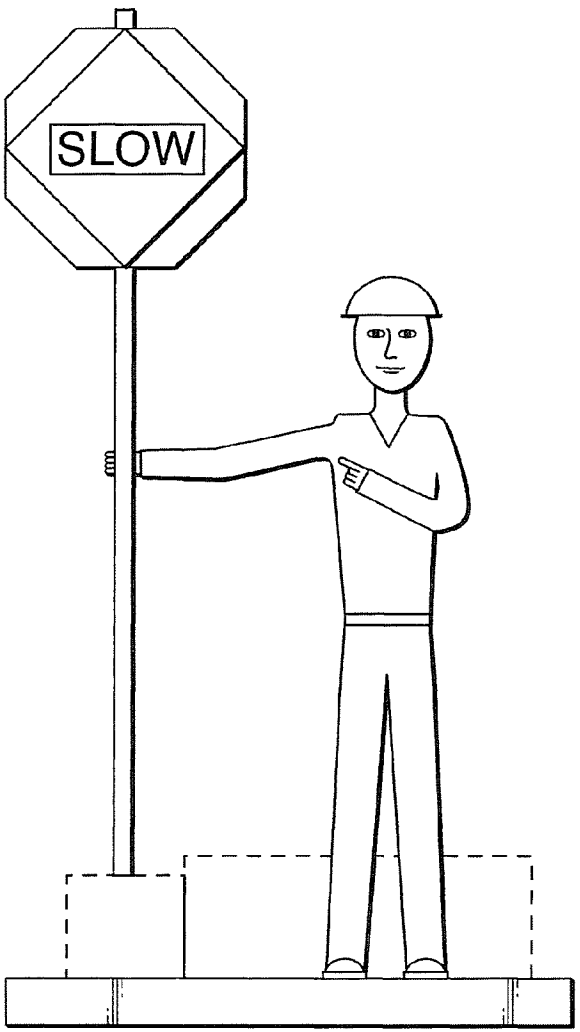
FIG. 1 is a front view of the traffic control system in accordance with an embodiment of the present invention.
Figure 1A:
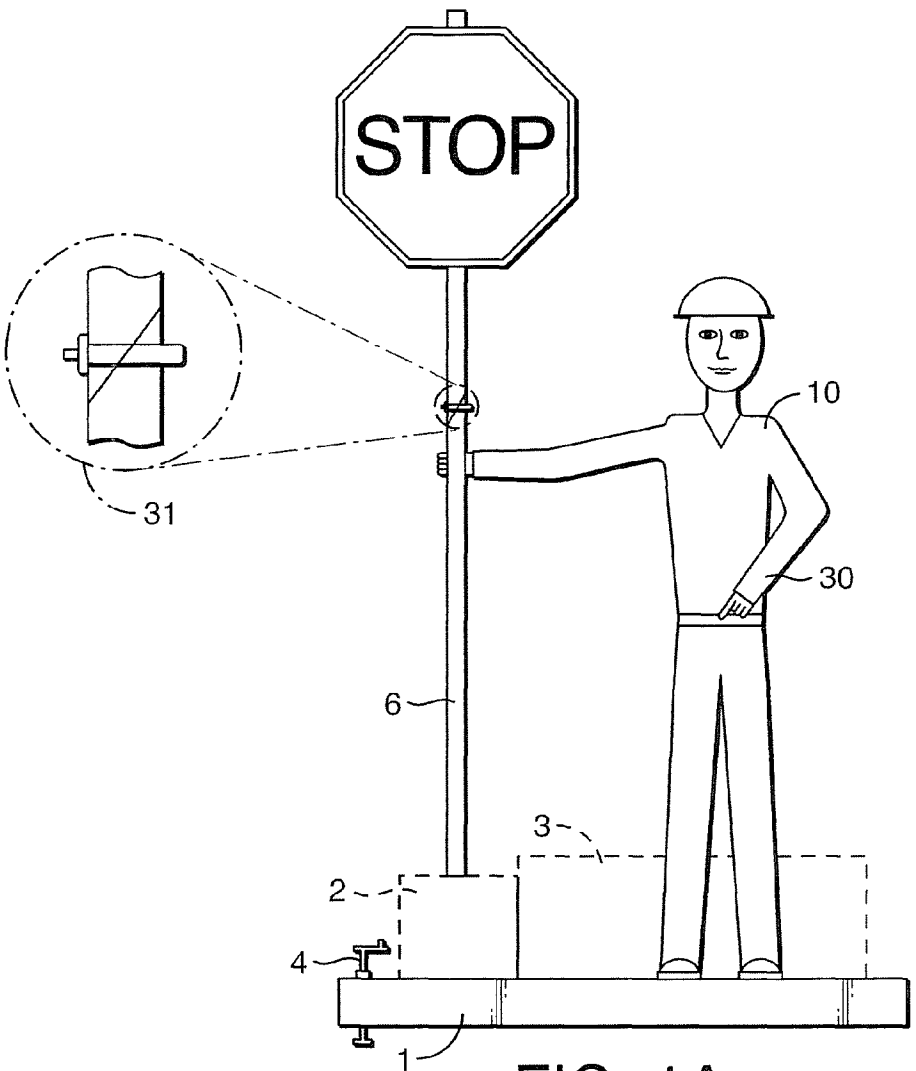

Referring to FIG. 1 shown is the traffic control system in accordance with a preferred embodiment from the front. The traffic control system has a two-sided sign 6 in both the 'Stop' and 'Slow' positions. The two-sided sign 6 may be attached to a vertical pole that is supported at the base 1 and hand 29 by bearings. The top portion of the sign 6 may be adapted to be removably and/or rotatably mounted to the pole to allow the sign to be manually turned if the unit's mechanics for transmitting device 9 malfunction. In addition, the top of the sign can also be removed during transport. The top portion of the sign 6 may be secured in place with a locking pin 31. The attachment point is, preferably, cut at an angle to ensure that the pin 31 cannot be inserted with the sign in the wrong position.

The base 1 has a statue-like or figurine 5, a battery storage compartment 3 and a control module compartment 2. On the corners of the base, manually adjustable legs 4 may be provided to allow for levelling on uneven surfaces. The battery storage compartment may, preferably, have a removable waterproof top to allow for charging of the batteries 7. The control module compartment, preferably, contains the radio receiver 12, on-off switch 11, voltage regulator 10, servo 13, air compressor 15, air storage tank 16, air valve 22 and the mechanical mechanism (large gear 24, small gear 25, air regulator—sign 20, air cylinder—sign 18, return spring 23) for turning the sign. However, any other device and/or component known to a person skilled in the art may be added, if needed, for suitable operation of the control module in conjunction with the other parts/components of the traffic control system.

Figure 2:
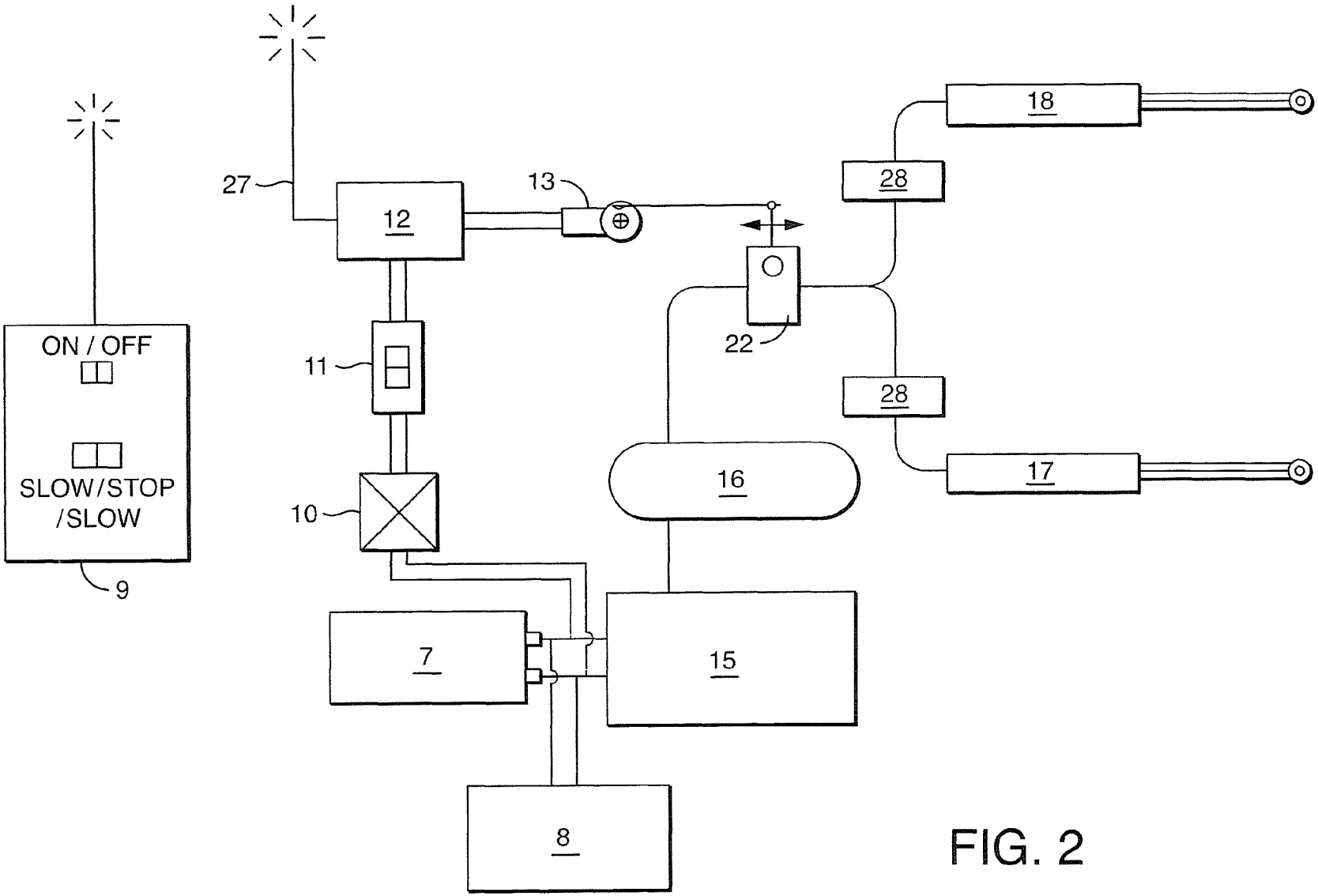
FIG. 2 is a schematic diagram of an embodiment of the electronic and mechanical components of the Control Module for the traffic control system of the present invention.

FIG. 2 is a schematic of the controls system for the invention. In the basic unit, a transmitter 9 is used to control the two remote units. A 3-position switch is used to turn the signs and control the direction of the traffic as follows (assume a construction site set up on a two-lane highway running East/West with traffic restricted to one-lane using the Northern lane; one automated unit has been setup at each end of the lane restriction; automated TCP-operator is positioned between the two units pointing North):

LEFT (slow)—West sign is in the 'Slow' position, East sign is in the 'Stop' position, traffic is allowed to move to the East through the lane restriction.

Center (stop)—both signs are in the 'Stop' position, traffic from the West is now stopped and both signs are maintained in this position until the Eastbound traffic in the lane restriction has exited the site, traffic to the East is still stopped.

RIGHT (slow)—East sign is turned to 'Slow', West sign is in the 'Stop' position, traffic is allowed to move to the West through the lane restriction.

The transmitted signal is picked up by a receiver 12 in the automated Traffic Control Persons through an antenna 27. The receiver 12 obtains its power, running through a voltage regulator 10, from a battery 7. This battery 7 may be equipped with an optional Solar Panel 8 for maintaining the batteries in peak condition. When the signal is received, the receiver 12 will activate a servo 13, causing it to move in one of two directions. This will activate an air valve 22 and will either allow the pressurizing of the two air cylinders (one for the sign 18 and one for the moveable arm 17) or allow the release of air which will return the sign and arm to the 'Stop' position. The air pressure will come from an air storage tank 16. This tank will be maintained in a regulated pressurized state by an air compressor 15 attached to the battery 7. Air pressure regulators 28 will be positioned between the air valve 22 and the air cylinders 17, 18 to allow the speed of the moveable units to be controlled and adjusted.

Figure 3:
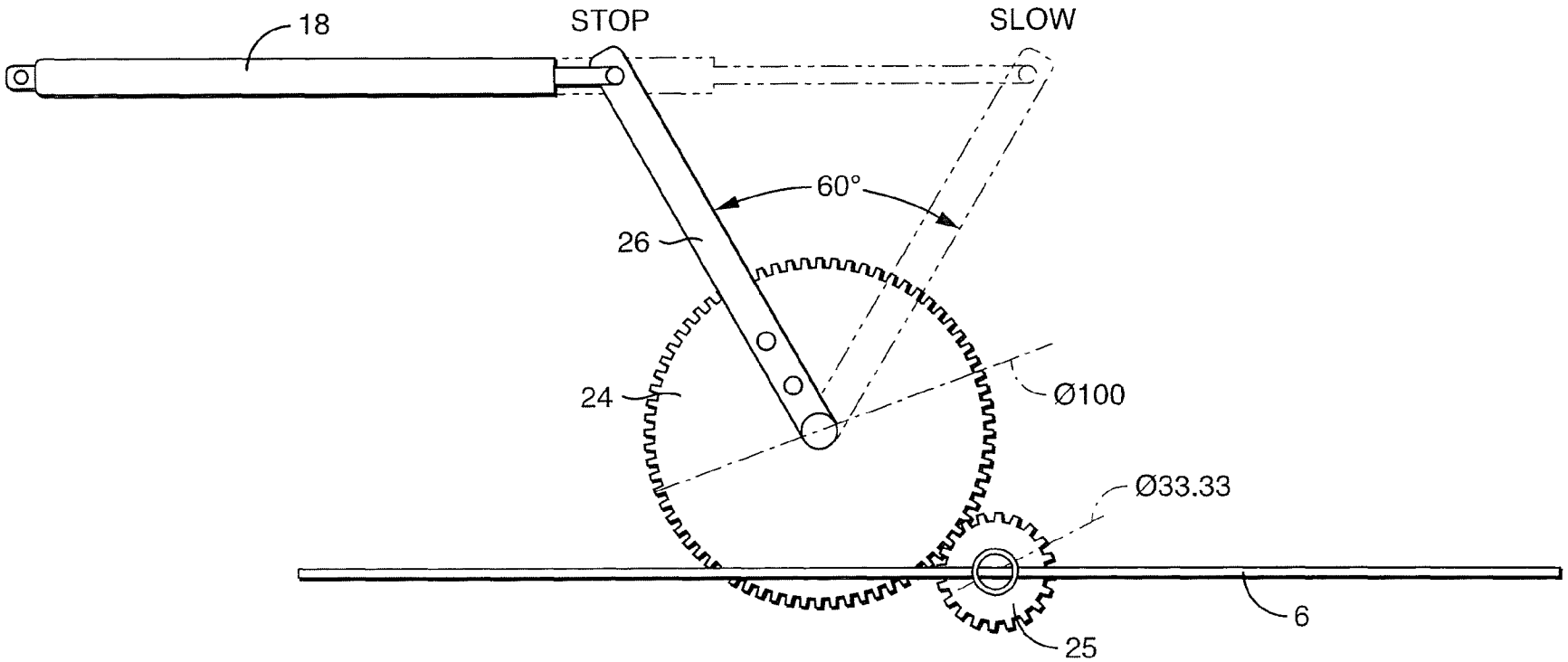
FIG. 3 is a view of the actuating controls for the base of the sign in accordance with an embodiment of the present invention.

FIG. 3 shows the actuator unit for rotating the sign 6. All of the components will be placed in the control module compartment 2. When the air cylinder 18 is pressurized, the piston will extend. The end of the piston will be attached to a control arm 26 which is affixed to a large gear 24. This movement of the piston will cause the large gear 24 to rotate to a fixed degree. The large gear's movement will turn a small gear 25. The sign post 6 is inserted into the small gear 25 and will therefore move with the small gear. The required 180° rotation of the sign 6 will be accomplished through the ratio between the large gear 24, small gear 25 and the degrees of movement for the control arm 26.

Figure 4B:
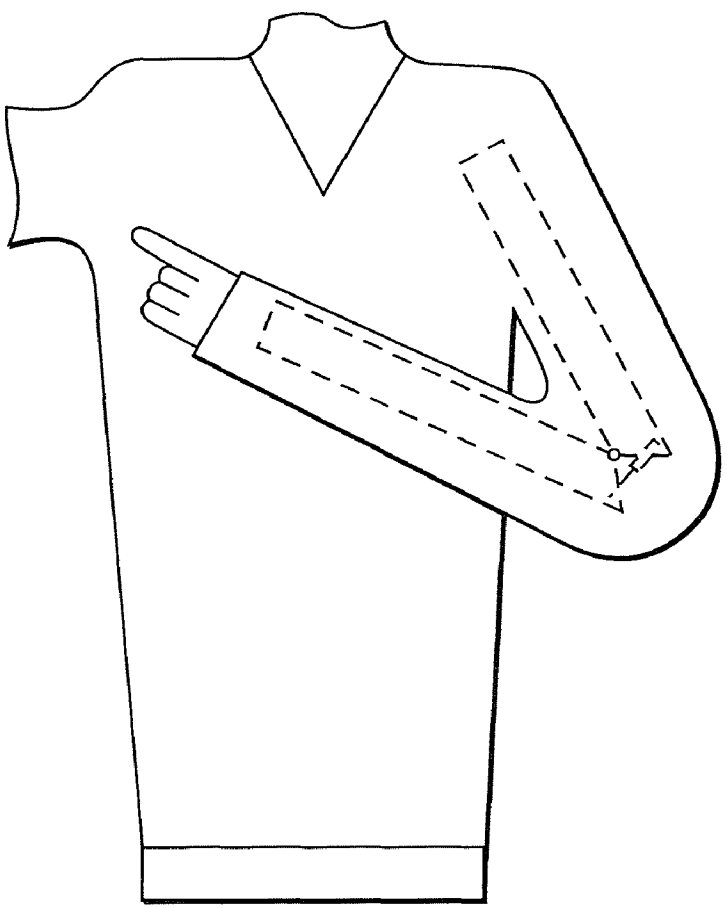
FIG. 4 is a view of the actuating controls for the movable arm in accordance with an embodiment of the present invention.
Figure 4A:
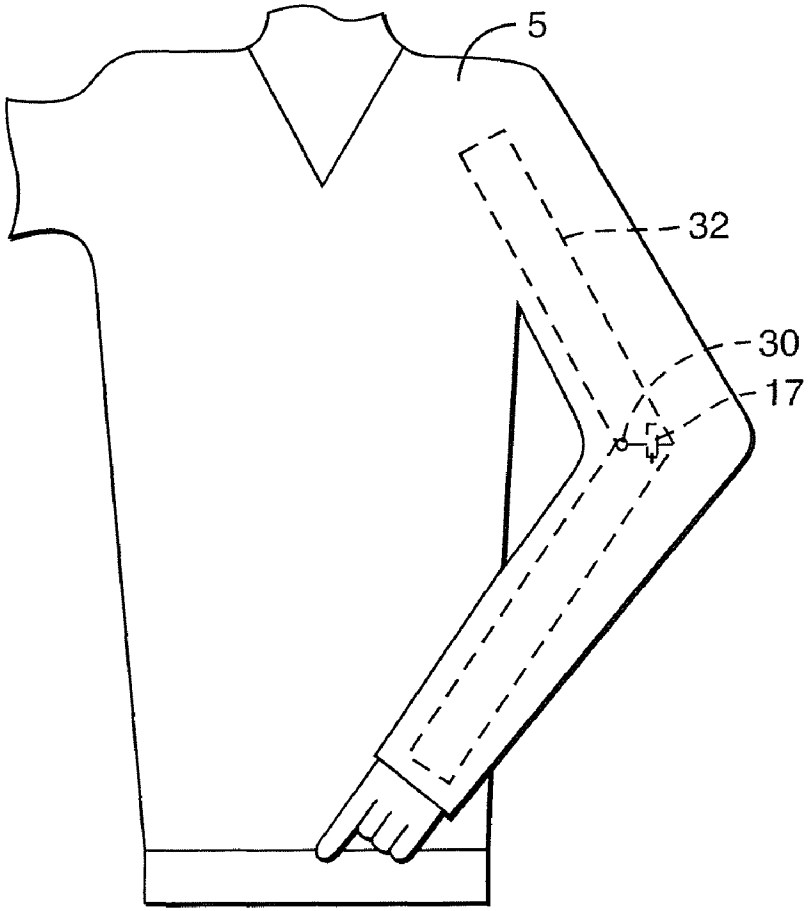

FIG. 4 shows the moveable left arm 30. The left arm 30 of the figurine 5 will be hinged and controlled with an air cylinder 17 to allow the arm to point at the designated stop location when the sign is in the 'Stop' position and will point at the sign when the sign is moved to 'Slow'. Positive air pressure will lift the arm by means of an air cylinder 17 to the 'Slow' position and the release of air, in conjunction with the weight of the arm, will move the arm to the 'Stop' position.

Figure 5:
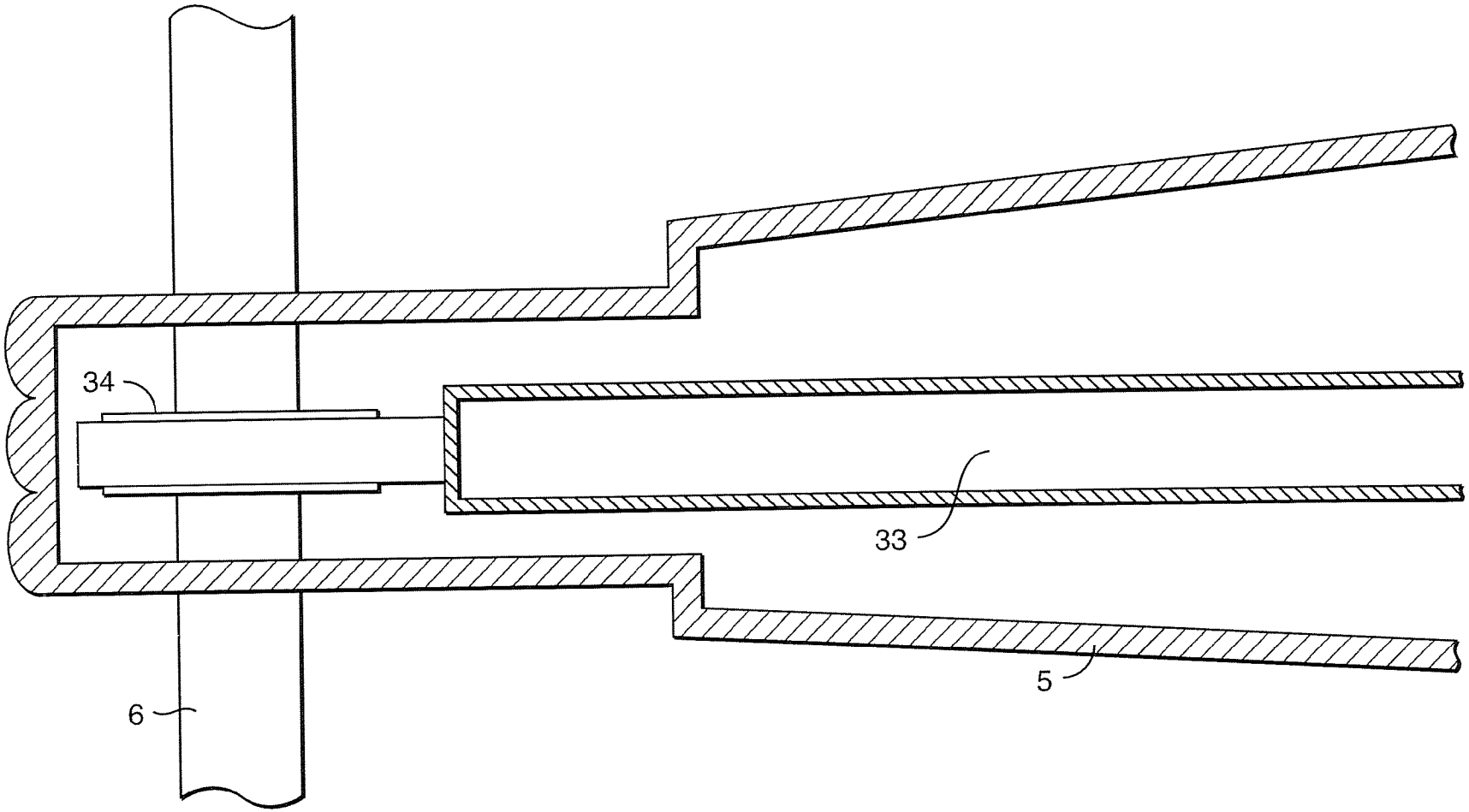
FIG. 5 is a view of the sign pole support located in the right hand in accordance with an embodiment of the present invention.

FIG. 5 shows the support structure for the sign 6 in the right hand/arm of the figurine 5. A bearing 34 will be inserted into the arm framework 34 with the sign post 6 running through the bearing.

The adjustable traffic control system of the present invention provides an adaptable, economical and easy to use alternative for providing a remote control system in non-user friendly environments. Compared to other traffic control systems already known in the art, the present invention requires minimal adaptation to varying environments and the minimal installation. The traffic control system of the present invention has an animated feature and fixture indicative of a human traffic control operative. The system uses a synchronized movement of both features and fixtures to animate the operative giving occupants in vehicular traffic a clearer and visually approachable indication to move forward or stop or any other form of direction that may be required for a situation that needs to control traffic.

While the drawings and description show the construction and use of the invention in full and precise detail, it is not the intent to limit the possibility of changes and/or variations in construction materials & techniques or to limit modifications to enhance the use of the invention. All such modifications or variations are within the scope of the invention as described in the claims appended hereto.

I claim:

1. A robotic traffic signaling system comprising:

a weighted base member for resting upon a ground surface;

a statue-like member being generally hollow and being securely mounted upon said weighted base member and having a first and second arm-like members comprising a hand-like member attached to each arm-like member at a distal point thereof;

a pole rotatably mounted on the base member and extending upwardly therefrom and rotatably through the hand-like member of the first arm-like member;

a traffic sign member comprising a first side and a second side and being removably mounted upon the pole member; and control means for bending the second arm-like member to point at a designated stop location when the traffic sign displays the first side thereof and to point at the sign when the traffic sign displays the second side thereof.

2. The robotic traffic signaling system according to claim 1, wherein the traffic sign member comprises a word "STOP" being displayed upon the first side thereof, and further comprises a word "SLOW" being displayed upon the second side thereof.

3. The robotic traffic signaling system according to claim 1, wherein the second arm-like member is hinged at the elbow.

4. The robotic traffic signaling system according to claim 1, wherein the pole is rotatably mounted on the base member and extends upwardly therefrom and rotatably through the hand-like member of the first arm-like member by means of a low-friction part.

5. The robotic traffic signaling system according to claim 4, wherein the low-friction part is a bearing.

6. The robotic traffic signaling system according to claim 1, further comprising control means for rotating the traffic sign.

7. The robotic traffic signaling system according to claim 6, wherein the control means for rotating the traffic sign comprises an air cylinder, a control arm attached at an end thereof to the air cylinder, a large gear which is attached to the control arm and actuated by the control arm and a small gear in operable contact with the large gear, and wherein rotation of the traffic sign mounted on the pole is accomplished by rotation of the pole mounted to the small gear by a rotation angle proportional with the ratio between the large and small gears and the degrees of movement of the control arm.

8. The robotic traffic signaling system according to claim 7, wherein the rotation angle is 180 degrees.

9. The robotic traffic signaling system according to claim 1, wherein the control means for bending the second arm-like member comprises an air cylinder.

10. The robotic traffic signaling system according to claim 7, wherein the control means for rotating the traffic sign and the control means for bending the second arm-like member are synchronous.

11. The robotic traffic signaling system according to 1, further comprising adjustable supports mounted on the base member for leveling.

12. The robotic traffic signaling system according to 1, further comprising a battery storage compartment and a control module compartment, the compartments being located in the base member.

13. The robotic traffic signaling system according to claim 1, further comprising remote control means capable of communicating commands from an operator to the control means thereby allowing the operator to control the system from a remote location.

14. The robotic traffic signaling system according to claim 1, further comprising video means to view, transmit or record images of the vicinity of the traffic signaling system.

15. The robotic traffic signaling system according to claim 1, further comprising audio means to record, transmit, or playback audio from or in the vicinity of the traffic signaling system.

16. A method for remotely controlling traffic, the method comprising the steps of:

providing a robotic traffic signaling device comprising at least one energy storage unit, wherein the robotic traffic signaling device is statue-like and is clothed with personnel protective equipment;

providing a base for stabilizing the robotic traffic signaling device;

performing, by the robotic device, a predetermined task of signaling the traffic by actuating a synchronized movement of an arm of the statue-like device and rotation of a traffic control sign for controlling onward traffic, wherein the arm of the statue-like device points at a designated stop location, when the traffic control sign displays the word "STOP", and at the traffic control sign, when the traffic control sign display the word "SLOW".

17. The method according to claim 16, further comprising the step of providing video or audio communication means to allow an operator to observe or interact with the vicinity of the robotic traffic signaling device.

18. The method according to claim 16, wherein the predetermined task of signaling the traffic is controlled by an operator from a remote location.

* * * * *